US005829842A

United States Patent [19]

Lombardo

[11] Patent Number: 5,829,842

[45] Date of Patent: Nov. 3, 1998

[54] RECYCLABLES COLLECTING TRUCK

[76] Inventor: Santo J. Lombardo, 141 Mountain Rd., Glastonbury, Conn. 06033

[21] Appl. No.: 689,799

[22] Filed: Aug. 14, 1996

[51] Int. Cl.[6] ..... B65F 3/00

[52] U.S. Cl. ..... 298/23 R; 296/56; 298/22 J

[58] Field of Search ..... 296/56; 298/7, 298/23 M, 22 R, 22 J, 23 R; 414/408, 409; 220/909

[56] References Cited

U.S. PATENT DOCUMENTS

| | | | |
|---|---|---|---|
| 4,915,570 | 4/1990 | Rath et al. | 414/409 |
| 5,078,567 | 1/1992 | Lombardo . | |
| 5,335,958 | 8/1994 | Christenson et al. | 296/56 |

FOREIGN PATENT DOCUMENTS

| | | | |
|---|---|---|---|
| 2 263 093 | 7/1993 | United Kingdom | 414/408 |

*Primary Examiner*—Janice L. Krizek

*Attorney, Agent, or Firm*—Pepe & Hazard LLP

[57] ABSTRACT

A truck for separately storing and discharging recyclable materials includes a chassis, a cab, and a frame pivotably mounted on the chassis rearwardly of the cab and supporting a housing with a platform extending along one side to the cab. Partition walls in the housing divide the interior space into a multiplicity of compartments along the length of the housing and a side wall has openings providing access to the several compartments. The partition walls have gates which are held in closed position by locks which are remotely releasable. An upper compartment is provided on the housing and a chute extends upwardly from an opening in the side wall, and a deflectable closure for the opening permits insertion of recyclable materials thereinto. A diagonally extending door is provided on the rear end of the cab adjacent the platform and is slidable between a closed position closing the cab and an open position extending along the adjacent side wall to permit passage between the cab and the platform.

21 Claims, 8 Drawing Sheets

RECYCLABLES COLLECTING TRUCK

BACKGROUND OF THE INVENTION

The present invention relates to trucks for collecting refuse, and, more particularly, to trucks for separately collecting and discharging recyclable materials.

In recent years many communities and states have developed programs for segregation in the collection of recyclable materials so as to minimize consumption of natural resources and exhaustion of landfills. In a number of states and communities, programs for recycling have been mandated, and there has been an increase in need for refuse collection trucks which would permit expeditious pick-up and temporary segregated transport of the recyclable materials, and ultimate separate discharge at collection centers maintained by the community.

To achieve this result, various mechanisms have been proposed for addition to refuse trucks to segregate the collected recyclable materials and ultimately to discharge such materials. Unfortunately, many of the proposed mechanisms have been relatively complicated and expensive to build and to operate. Still others have required a high degree of handling by the operator of the materials both in loading the materials onto the truck and thereafter in removing the materials from the truck at the municipal collection site. Still others have been relatively complex in construction or had a limited number of compartments.

It is an object of the present invention to provide a novel truck for expeditiously collecting, storing in segregated areas, and discharging a variety of recyclable materials.

It is also an object to provide such a truck which may be fabricated readily from rugged materials to provide a long lived structure.

Another object is to provide such a truck in which the operator may readily and separately store the collected recyclables in a multiplicity of compartments within the truck and separately discharge the materials from the compartments into storage containers at the municipal collection site with a minimum of handling.

Still another object is to provide such a truck incorporating an overhead compartment into which recyclables can be readily introduced and other compartments which may be adjusted in volume to suit the needs of a particular community or of a particular collection route.

SUMMARY OF THE INVENTION

It has now been found that the foregoing and related objects may be readily attained in a truck for separately storing and discharging recyclable materials including a chassis with a cab on its front end and having side walls and front and rear ends. A frame is pivotably mounted on the chassis and extends rearwardly of the cab. It includes a pair of parallel spaced side rails, and a plurality of spaced cross members extending transversely between the side rails and outwardly therefrom. Supported on the frame is a housing having front, rear, side, top and bottom walls, and a platform extends along one side of the housing to the cab. There is at least one door in the rear wall of the housing.

Vertically oriented, transversely extending partition walls in the housing divide the interior space into a multiplicity of compartments along the length of the housing, and one side wall of the housing has a multiplicity of openings each communicating with one of the compartments. The partition walls between the compartments have gates therein to provide a passage between the compartments, and the assembly includes locking mechanisms for holding the gates in a closed position and a remote release mechanism for unlocking the locking mechanisms and allowing the gates to open.

An upper compartment is provided above at least one of the compartments and it has a gate for discharge of its contents. A chute extends upwardly between an opening in the side wall and the upper compartment, and a deflectable closure for the opening permits insertion of recyclable materials thereinto and retention of such materials in the chute.

A diagonally extending door is provided on the rear end of the cab adjacent the platform, and it is slidable between a closed position closing the cab and an open position extending along the adjacent side wall so that an operator may move from the cab onto the platform to place a multiplicity of types of recyclable materials in the several compartments for separate storage. Thereafter, the materials may be separately discharged by first opening the rear door to discharge the material in the rearmost compartment, and then selectively opening the gates of the remainder of the compartments to discharge the material therein.

Desirably, the door of the cab is slidably mounted on tracks. The upper compartment has front, rear and side walls and is disposed on the top wall of the housing which provides its bottom wall. The upper compartment extends to the rear wall of the housing, and the gate of the upper compartment is in the rear wall of the compartment.

Preferably, the deflectable closure for the chute has a multiplicity of vertically spaced horizontally extending slits, and a vertically extending slit located intermediate the width of the closure and generally bisecting the horizontally extending slits. Conveniently, the closure is made of an elastomer.

The top surface of the side rails and the cross members generally lie in the same plane to form a flat bed for supporting the housing thereon. The side rails are generally beams of generally box-shaped cross section, and the cross members are beams of generally C-shaped cross section. Preferably, the side rails include a channel member having a vertically extending web with its flanges extending horizontally outwardly, a second member having a base seated on the lower flange of the upwardly and outwardly extending web and an upper flange extending outwardly thereof, and a multiplicity of trapezoidal plate members extending between the channel member and the second member at spaced points along the length thereof to increase the structural rigidity of the side rails. Desirably, the frame and the housing are made of aluminum.

The truck desirably includes a vertically oriented, longitudinally extending partition wall between a pair of transversely extending partition walls to provide a pair of side by side compartments each with a gate, and the locking mechanism includes cam elements to move each of the gates into a closed position, the gate for one of the side by side compartments being supported on a first rotatable shaft, and the cam element for the gate of the side by side compartment being supported in a second rotatable tubular shaft concentric with the first shaft to rotate the other cam element, so that each of the shafts is separately rotatable. The remote release mechanism includes a mechanical linkage actuatable externally of the housing.

DETAILED DESCRIPTION OF THE ILLUSTRATED EMBODIMENT

Figures 1, 4:
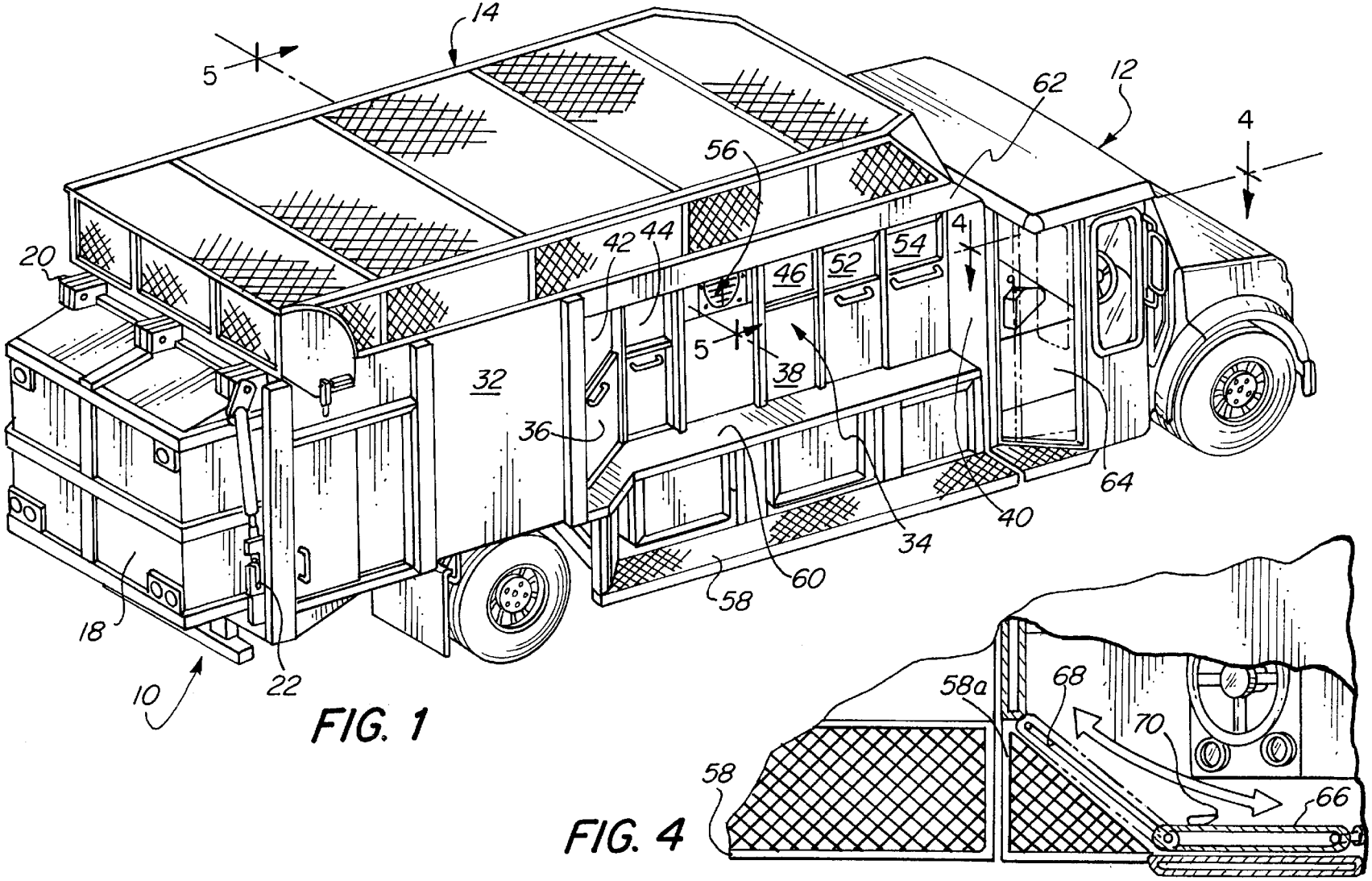
FIG. 1 is a perspective view of a collecting recyclables truck embodying the present invention.
FIG. 4 is an enlarged fragmentary view of the truck along line 4—4 of FIG. 1 with the arrows showing the sliding motion of the cab door.
Figure 2:
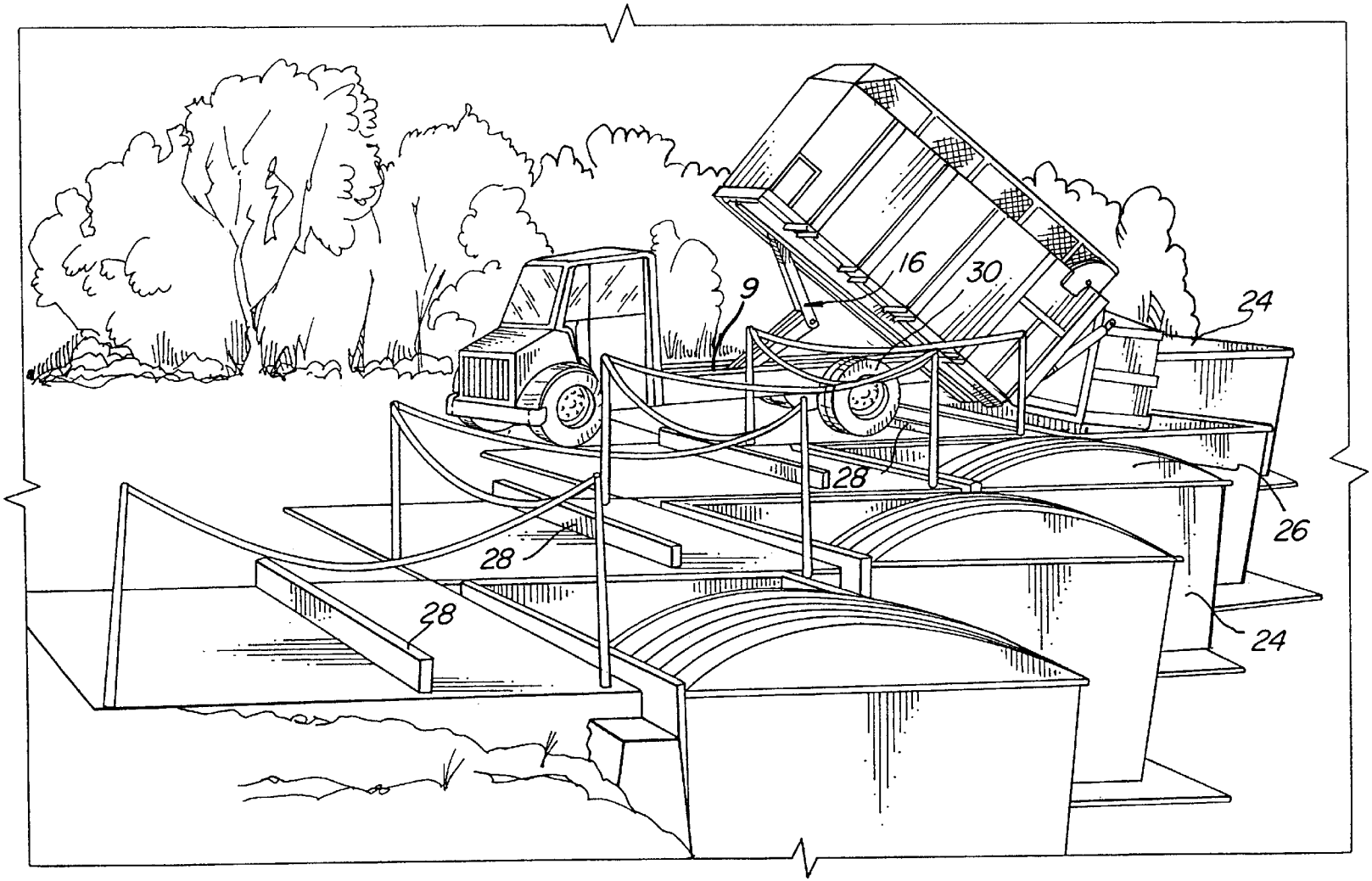
FIG. 2 is a perspective view of the truck of FIG. 1 in the process of discharging the contents of one compartment into a storage bin for that particular recyclable element.

Turning first to FIGS. 1 and 2, therein illustrated is a truck embodying the present invention which has a truck chassis generally designated by the numeral 9 (seen in FIG. 2), a cab generally designated by the numeral 12, and a container housing generally designated by the numeral 14. As seen in FIG. 2 the container housing 14 may be pivoted upwardly and downwardly by a hydraulic lift mechanism generally designated by the numeral 16. The container housing 14 has a rear door 18 in its rear wall which is mounted on hinges 20 and which is locked in closed position by the latch 22.

As seen in FIG. 2, the door 18 at the rear of the truck may be opened by releasing the latch 22 and the hydraulic mechanism 16 may be utilized to pivot the front of the container housing 14 upwardly so as to discharge material within the storage container 14 into one of the selected group of bins 24. Each of the bins 24 is dedicated to a particular type of recyclable material and is provided with a removable or displaceable cover 26. To facilitate alignment of the truck in the proper position for discharging its contents into the bins 24, stops 28 are provided on the drive surface, and the rear wheels 30 abut thereagainst.

Returning to FIG. 1, intermediate the length of the side wall 32 is formed an alcove generally designated by the numeral 34 which is essentially defined by three rectilinear walls 36, 38 and 40. The walls 36 and 38 have a series of openings 42, 44, 46, 52 and 54 formed therein. A deflectable closure generally designated by the numeral 56 extends across still another opening in the side wall 38. The alcove 34 has a platform 58 along the entire length thereof upon which the operator may stand during the process of placing the recyclable materials into the truck. The truck is also configured to provide a shelf 60 above the platform 58, and a canopy 62 is provided over the alcove 34 to provide protection for the operator as he or she is placing materials in the separate openings.

The cab 12 includes a rearwardly facing portal 64 through which an operator may step out directly from the cab 12 onto platforms 58*a* and 58 while remaining under the cover of the canopy 62.

Figure 3:
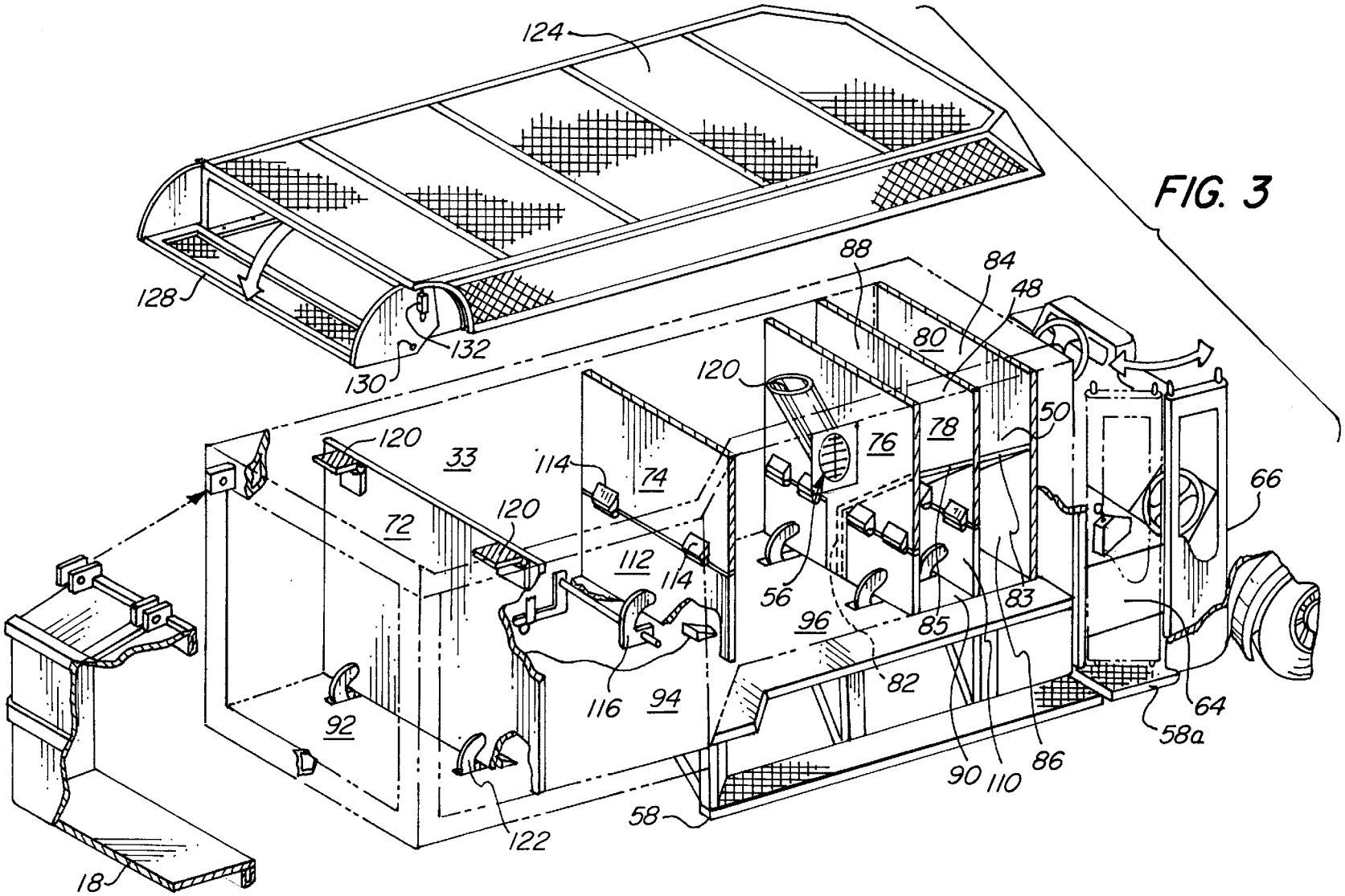
FIG. 3 is a fragmentary perspective view in partial section of the truck with portions exploded from the container housing.

As illustrated in FIGS. 1, 3 and 4, the portal 64 includes a sliding and pivoting door 66 which is slidably supported on tracks 68 in the floor and roof (not shown) of the cab 12 along the side wall of the cab. Using the handle 70 attached thereto, an operator may quickly and easily slide the door 66 open in the forward direction and close it by sliding it in the rearward direction, as indicated by the arrows in FIGS. 3 and 4. The tracks 68 extending parallel to the side wall of the cab guide its movement after it is pivoted into alignment therewith.

Turning now to FIG. 3, therein illustrated is the general interior construction of the container housing 14 which is divided into a series of compartments by partitions provided by repositionable walls as will be described more fully hereinafter.

Extending transversely of the container housing 14 between the sidewalls 32 and 33, is a rear partition wall 72. Forwardly thereof and extending transversely between the side wall 33 and the alcove wall 38 is a second partition wall 74. Forwardly thereof and extending transversely between the sidewall 33 and the alcove wall 38 are partition walls 76,78. Extending longitudinally from the partition wall 74 to the front wall 80 is a short divider wall 82 shown in phantom line, and extending generally transversely and upwardly from the top of the wall 80 to the alcove wall 38 are chutes 83, 85.

By the latter series of partitions, the forward portion of the container housing is divided into side-by-side compartments, including the left front compartment 84 and right front compartment 86 defined by the front partition wall 78, front wall 80 and short divider wall 82. Defined between the partition wall 76, front partition wall 78, and short divider wall 82 are the left and right compartments 88 and 90.

Concurrently referring to FIG. 1, it can be seen that the openings 52, 54 in the wall 38 directly communicate with the right compartments 90, 86, respectively, for introduction of material thereinto. The chutes 83, 85 extend from the openings 48, 50 formed in the wall 38 and discharge into the left compartments 88, 84.

The partition walls divide the rear portion of the container housing 14 into a series of large volume, transversely extending compartments, namely, the rear compartment 92 defined by the rear door 18, and the partition wall 72. Defined between the partition walls 72, 74 and 74, 76 are the middle-rear compartment 94 and the middle compartment 96, respectively.

The openings 42, 44 directly communicate with the middle-rear compartment 94 and the middle compartment 96, respectively, for introduction of material thereinto.

Each of the transversely extending partitions has one or more gates therein to permit discharge of the contents of the compartment forwardly thereof.

Figure 5:
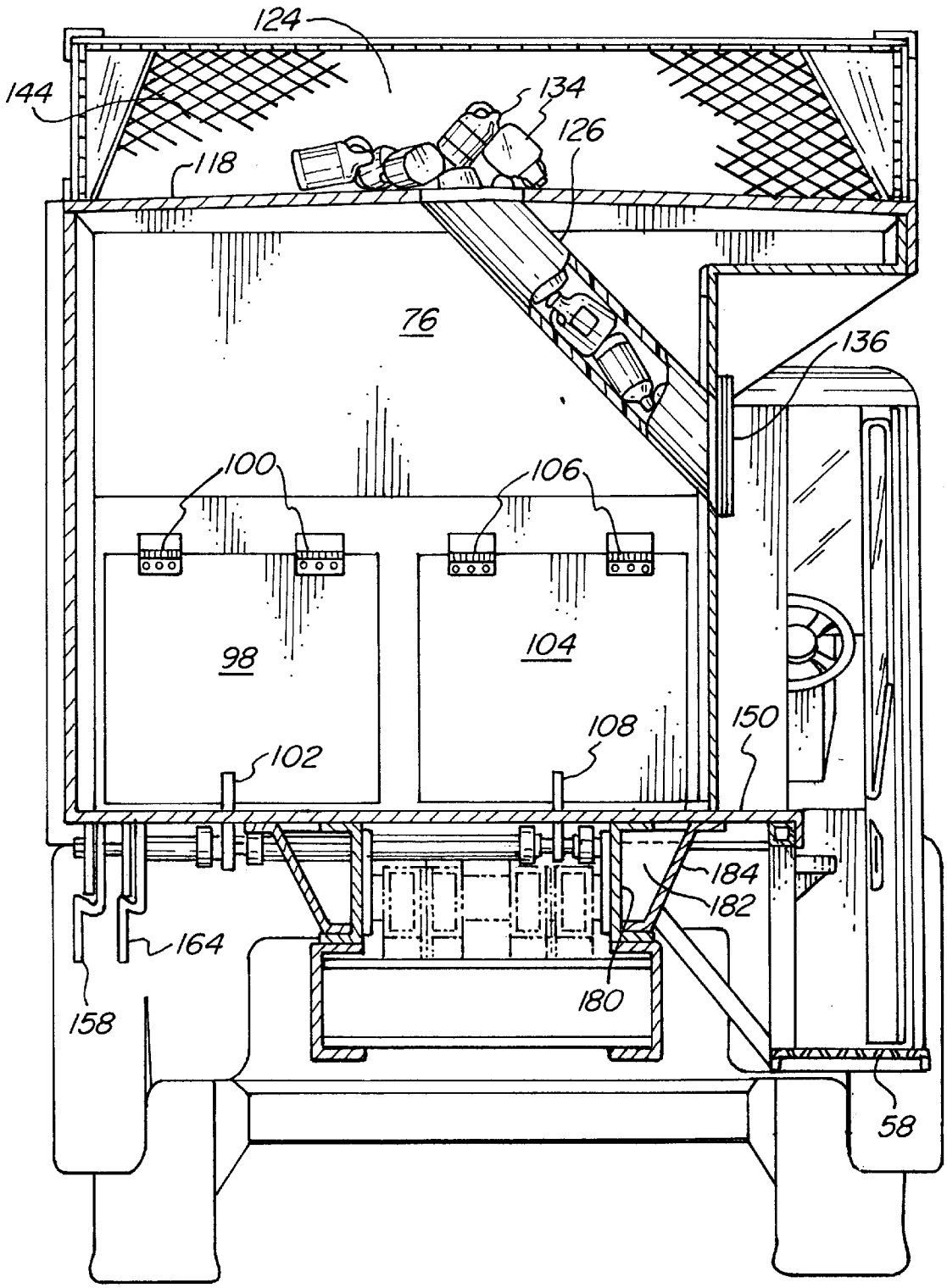
FIG. 5 is a vertical sectional view of the truck along line 5—5 of FIG. 1.

As seen in FIG. 5, the partition wall 76 has two gates or doors 98, 104 therein. The gate 98 is mounted thereon by the hinges 100, and locked by the latch generally designated by the numeral 102, and the gate 104 is mounted on the hinges 106 and locked by the latch generally designated by the numeral 108. When these gates 98, 104 are opened, material can be discharged from the compartments 88 and 90.

As partially seen in FIG. 3, the front partition wall 78 has a front right gate 110 located directly in front of gate 104, and a front left gate (not shown) located directly in front of gate 98 having a configuration identical to those of gates 98,104 in the partition wall 76. When these front gates are opened, material may be discharged from the front compartments 84 and 86.

As seen in FIG. 3, the partition wall 74 has one gate 112 mounted thereon by the hinges 114, and locked by the latch 116. The entire partition wall 72 acts as a gate suspended from the roof wall 118 by the hinges 120 attached thereto and locked by the latches 122. Both of these doors or gates 72,112 extend transversely across the width of the container housing 14, and when these are opened, material can be discharged from the compartments 92 and 94, respectively.

As illustrated in FIG. 5, an upper compartment 124 is disposed above the roof wall 118 of the container housing 14. An upwardly inclined tubular chute 126 is provided to guide materials introduced through the closure 56 upwardly through an opening in the roof wall 118 into the compartment 124.

Figure 6:
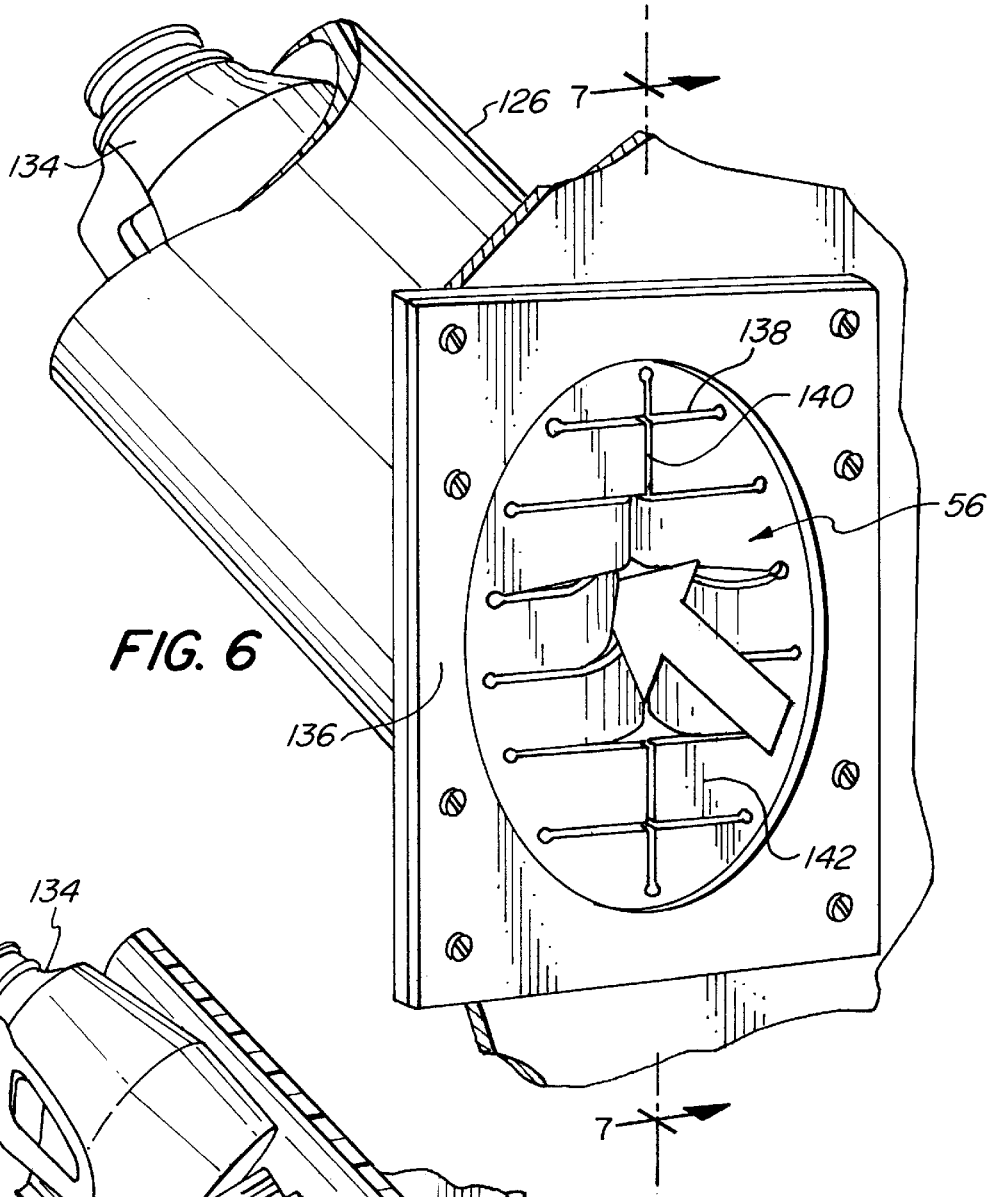
FIG. 6 is an enlarged fragmentary view of the container chute with the arrow showing the deflection of the diaphragm.
Figure 7:
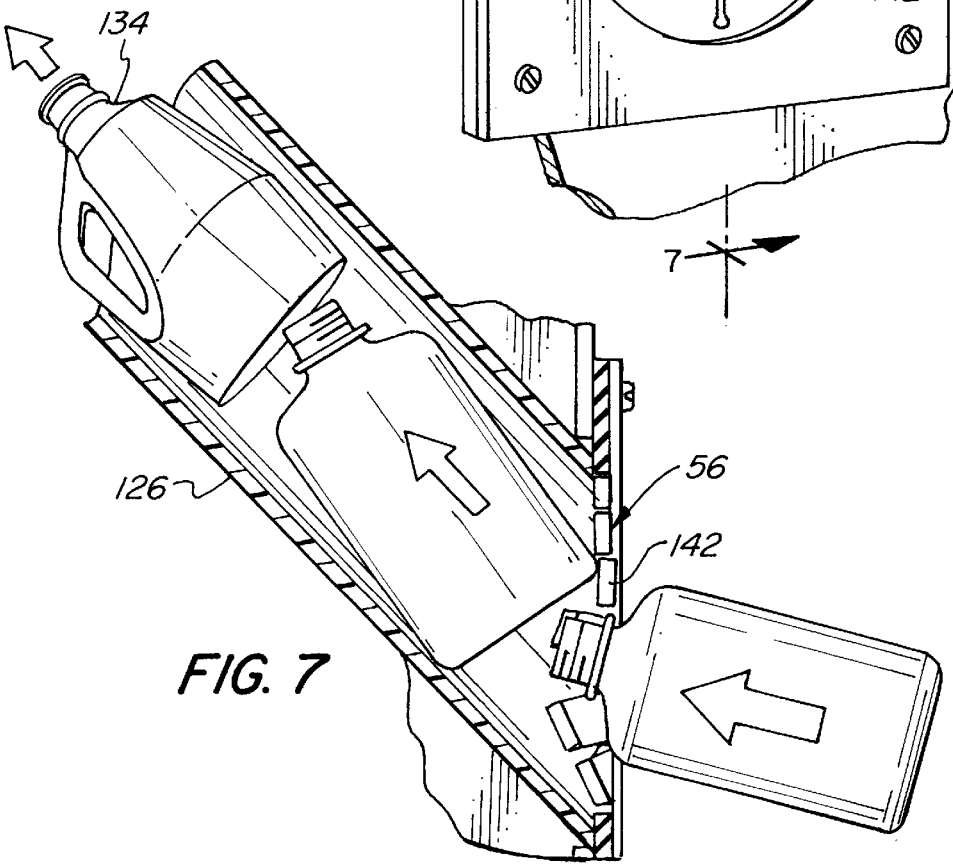
FIG. 7 is a fragmentary sectional view along line 7—7 of FIG. 6 with the arrows showing the movement of plastic containers through the chute.

As illustrated in FIG. 6, the resiliently deflectable closure 56 is mounted transversely across the opening to the chute 126 and upon the wall 38 by a rectangular plate 136 with an oval aperture therein. The closure 56 has horizontally extending slits 138 which are bisected by a vertically extending slit 140 located to form flexible flaps 142. In operation, the flaps 142 are readily inwardly deflected by upwardly and inwardly forcing bottles 134 thereagainst in the direction indicated by the arrows in FIGS. 6 and 7. As bottles 134 are introduced through the diaphragm 56 into the chute 126, they abut previously inserted bottles 134 and thereby drive these upwardly along the chute 126 and into the upper compartment 124 where they collect therein as shown in FIG. 5.

The bottles 134 are generally made of synthetic resin and are generally lightweight so that the forces generated by the total weight of the bottles 134 within the chute 126 is insufficient to bend the flaps 142 outwardly sufficiently to allow the bottles 134 to exit therefrom. In addition, the chute 126 is elevated at approximately 450 to the horizontal so that only a partial component of the weight of the bottles 134 acts downwardly on the closure 56.

The chute 126 and closure 56 combination is a simple mechanism which allows the bottles to be readily and quickly deposited in the upper compartment 124. Moreover, the upper compartment 124 provides a large volume of space which would be difficult to access and which is ideally suited for lightweight objects such as the plastic bottles 134. In order to reduce weight, the walls of the compartment 124 are made of wire mesh 144.

A gate 128 is hingedly mounted on the rear of the compartment 124 by a hinge 130, and is secured by the latch 132. When it is opened, material stored in the top compartment 124 can be discharged therethrough.

Figure 8:
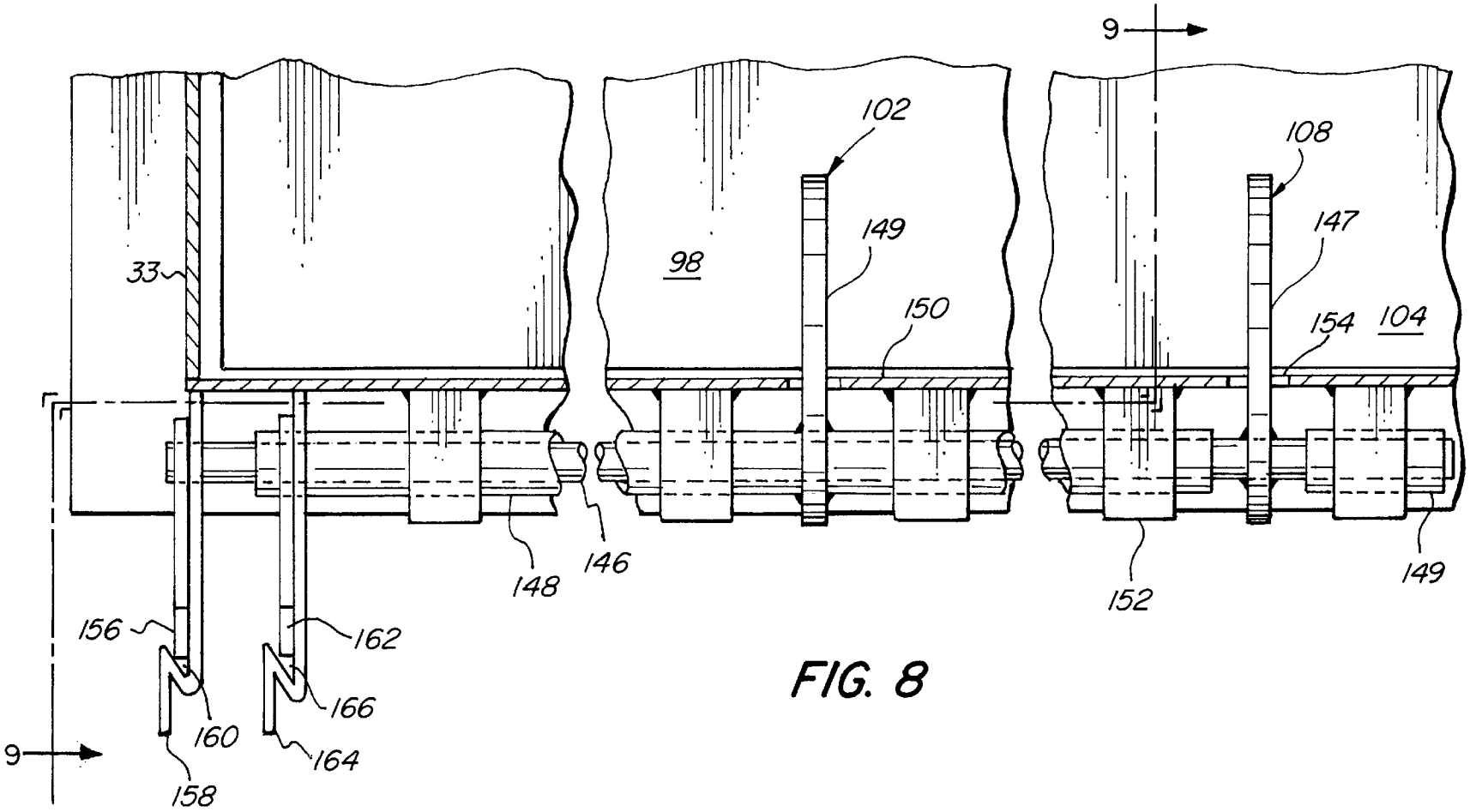
FIG. 8 is an enlarged fragmentary cross sectional view of the truck showing a compartment wall with gates and the mechanism for effecting locking of the gates in the closed position and thereafter effecting their release remotely.
Figure 9:
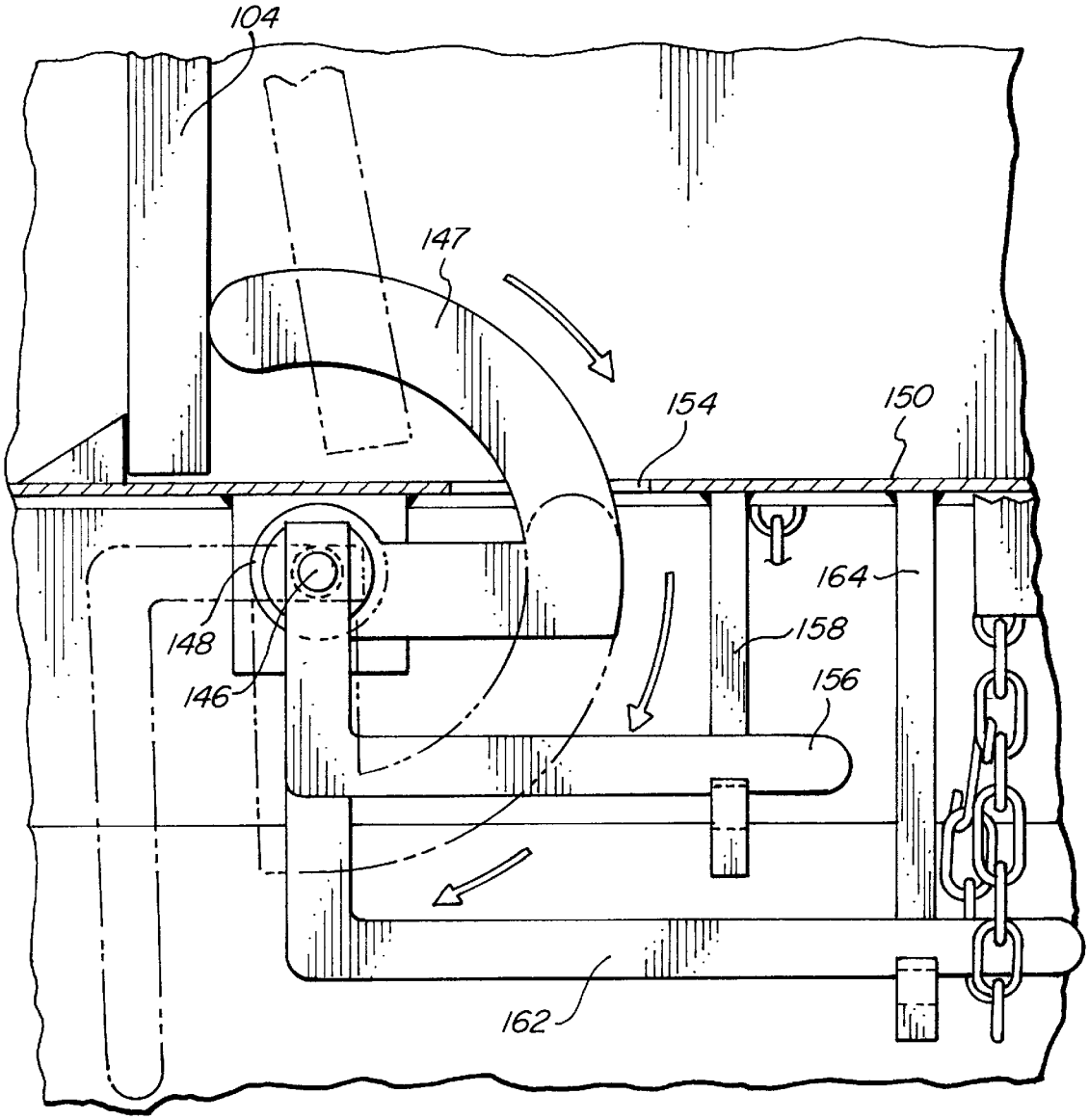
FIG. 9 is a fragmentary sectional view along the line 9—9 of FIG. 8 showing the gate and mechanism in the full closed position in solid line, and in an open position in phantom line.

Turning now to FIGS. 8 and 9, therein illustrated is the remotely operable mechanism for closing and locking the several gates to the right and left lower compartments 84, 86, 88 and 90. The drawings specifically illustrate the mechanism for locking the gates or doors 98, 104 for the front compartments 88, 90, i.e., the latch mechanisms 102, 108 as seen in FIG. 5. The latch mechanisms include the rotatable tubular shaft 148 in which is rotatably supported the rotatable shaft 146 which is also rotatably supported in the short tubular support 149. The tubular shaft 148 is rotatably supported on the bottom of the truck bed 150 by the brackets 152 spaced along its length and the short tubular support 149 is also supported by a bracket 152.

Mounted on the shaft 146 between the tubular shaft 148 and the short tubular support 149 is the latch arm 147 which has a rectilinear section extending from the shaft 146, and an arcuate section extending upwardly therefrom through an aperture 154 in the bottom wall 150. The end of the arcuate section is rounded and bears against the gate 104 to force it into a closed position and thereafter to hold it in a closed position.

To effect rotation of the shaft 146 and thereby the latch arm 147, the shaft 146 projects beyond the end of the tubular shaft 148 and has mounted thereon an actuator arm 156 of generally L-shaped configuration. As seen in FIG. 9, movement of the actuator arm 156 from the position shown in full line to the position shown in phantom line will rotate the shaft 146 and pivot the latch arm 147 away from a position bearing against the gate 104, and into an opening position in which the gate will pivot open when the container housing 14 is pivoted upwardly, as seen in phantom line. Conversely, rotation of the shaft 146 from the position seen in phantom line to the position shown in solid line will cam the gate or door 104 into the closed position from the partially open position seen in phantom line.

To hold the latching release mechanism and thereby the door 104 in latched position, a support member 158 depends from the bed 150 and has a recess 160 formed therein to seat the actuator arm 156. There is sufficient play in the mounting of the shaft 146 and of the actuator arm 156 to allow the actuator arm 156 to be removed from the recess 160 to effect the pivoting when desired.

The configuration and operation of the latch 102 is similar to that of the latch 108 and involves rotation of the rotatable tubular shaft 148 which is connected to the operator actuator arm 162. In this instance, the latch 102 is mounted on the exterior of the tubular shaft 148 and bears against the gate 98, and the actuator arm 162 is seated in recess 166 of the support member 164.

Figure 10:
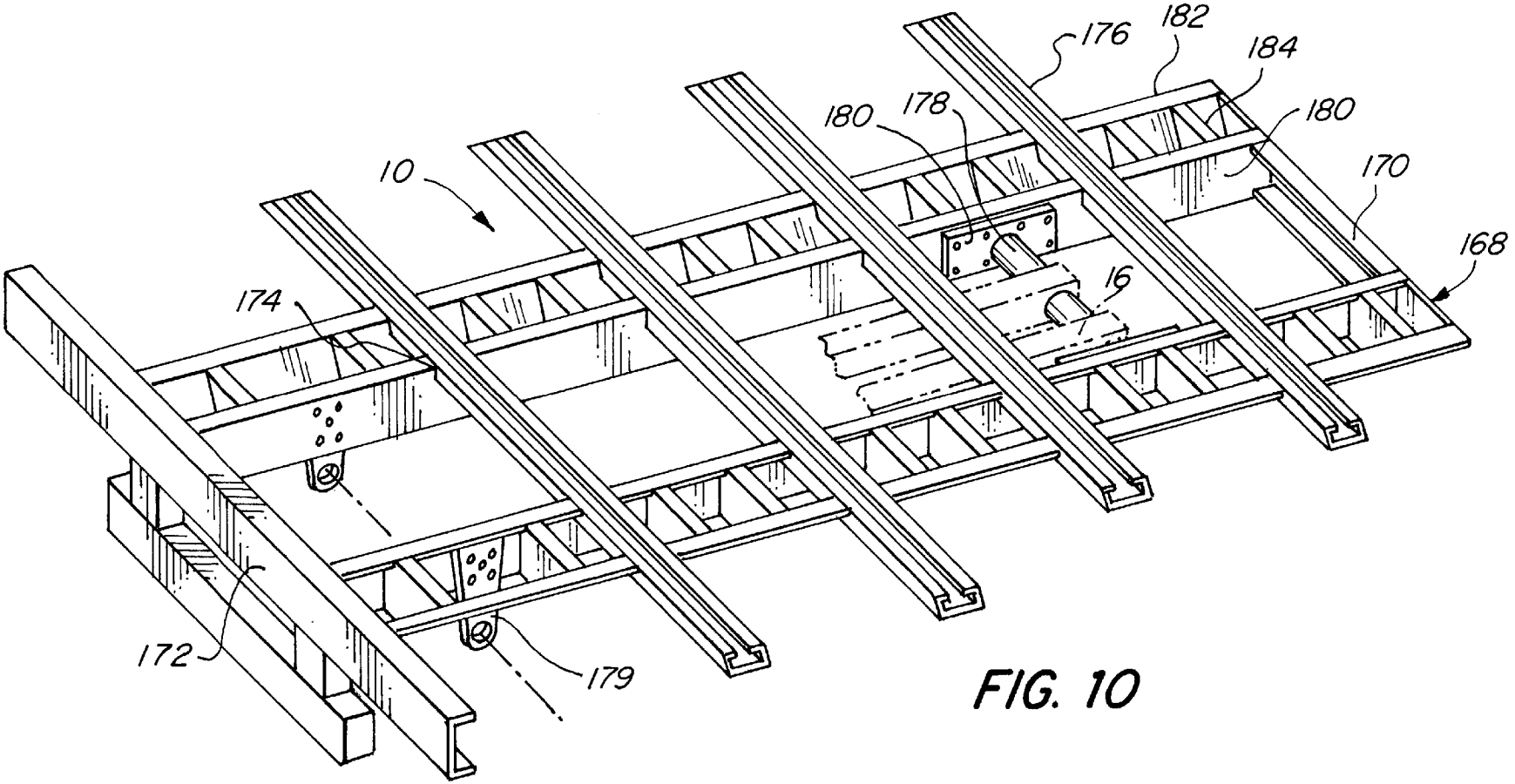
FIG. 10 is a perspective view of the light-weight frame for the container housing and showing the hydraulic lifting mechanism in phantom line.

Turning now to FIGS. 5 and 10, therein illustrated is a lightweight frame or base 10 for supporting the container housing 14 on the chassis 9. Extending longitudinally along the entire length of the container housing 14 is a pair of parallel spaced side rails generally designated by the numeral 168. Extending transversely between the side rails 168 at either end of the container housing 14 are a front channel beam 170 and a rear channel beam 172 which also serves as a bumper. The side rails 168 have rectangular notches 174 along their upper surface at regular spaced intervals in which are seated cross rails 176 extending transversely of the container housing 14 between the side rails 168 and outwardly thereof. The top surface of the cross rails 176 and side rails 168 lie in the same plane to form a flat surface for supporting the bed or bottom wall 150 of the container housing 14 directly thereon.

The hydraulic mechanism 16 is attached to the front portion of the chassis 9 and to the frame 10 along the inner surface of the side rails 168 by a shaft 178 extending transversely therebetween and secured to a mounting bracket 180 on the inner surface of the side rails 168. Two pivotal connections 179 for mounting the frame 10 to the chassis 9 of the truck are provided on the rear portion of the side rails 168 behind the rear tires 30 of the truck. The frame 10 and container housing 14 thereon pivot about the pivotal connections when the hydraulic mechanism 16 is actuated to lower or raise container housing 14.

Components of the frame 10 utilize structural sections such as channels and S-beams for increased strength and rigidity. More specifically the cross rails 176 are comprised of structural channels. The side rails 168 are comprised of a channel beam 180 having a vertically extending web and outwardly extending flanges at the upper and lower ends thereof, and of an S-beam 182 which has an upwardly and outwardly extending web and flanges extending inwardly and outwardly from its lower and upper ends respectively. The S-beam 182 is secured to the lower flange of the channel 180 along its lower inner flange. Trapezoidal plate members 184 extend perpendicularly between the channel 180 and S-beam 182 at spaced points along the length of the side rails 168 to increase the structural rigidity.

Turning to use of the illustrated embodiment of the truck of the present invention, conveniently the openings and the compartments therein are utilized as follows: The opening 42 is used to introduce paper into the large middle-rear compartment 94 provided between the two partition walls 72, 74. As discussed above, the closure 56 which communicates with the compartment 124 is utilized to slide synthetic resin products such as plastic bottles through the chute 126 into the upper compartment 124.

The opening 52 is utilized to introduce clear glass bottles into the right middle-front compartment 90. Through the opening 54, cans are dropped directly downwardly into the right-front compartment 86.

Green and brown glass bottles are separately introduced through the openings 48 and 50 and travel along the chutes 81 and 83 into the left middle front compartment 88 and left front compartment 84 respectively.

Provision has been made for the other storage compartments to segregate different types of recyclable materials by introducing it through the openings 52, 54 and it will drop downwardly into the compartments 90, 86 which are formed adjacent the sidewall 38.

As will be appreciated, the operator may step directly onto the platform 58 from the cab 10 to sort and place the recyclable materials being collected into the respective openings. During this period of time the operator is shielded from the elements by the overhang or canopy 62 above the alcove 34. Allowing the operator to step directly from the cab 12 onto the platforms 58*a* and 58 may, on average, save an operator 1,000 steps a day thereby reducing operator fatigue while increasing efficiency.

After the truck has completed its route, it then travels to the recycling center and is backed up to the first of the storage bins. The latch 22 for the door 18 is moved to the release position to allow the door 18 to be opened, and the hydraulic mechanism 16 is actuated to elevate the container housing 14 into the position seen in FIG. 2. This causes the recyclable material in the first compartment to be discharged into the first bin 24. As seen in FIG. 2, the truck has been backed up until the rear tires 30 abut the stop 28 adjacent the storage bin 24.

After the paper has been discharged, the hydraulic mechanism 16 is actuated to lower the container housing 14, and the truck is moved into alignment with the second storage bin 24 and the gates 72 and 112 are opened seriatim to discharge the contents of compartments 94 and 96, respectively. Thereafter, one of the gates 98 or 104 is opened to discharge the contents of the left or right compartments as the case may be. Generally, all of the compartments are discharged seriatim although it is possible to discharge one rear compartment and then open the gate to the forward compartment to effect discharge of its contents before opening the adjacent rear compartment. The sequence is a matter of choice from the standpoint of the orientation of the storage bins 24 at the recycling center.

As will be readily appreciated, it is desirable to be able to open the gates from the exterior of the truck so that a person does not have to enter the truck to open the several gates. This is particularly true with respect to the gates to the forward compartments which would require entering the rear compartments to do so. Although electrical and electromechanical latches and hydraulic latches may be employed to permit remote operation, the potential for injury to hydraulic and electric lines is such that a simple, mechanical linkage is desirable to permit remote operation from the sides of the truck.

Such a mechanical system is that illustrated in FIGS. 8 and 9, and the mechanisms 156, 162 are readily accessible from the side of the truck to open the gates. Moreover, it will be seen that the gates inside the container housing are all hinged at the top so that the weight of the door will tend to move the door or gate into the closed position when the container housing is in a horizontal position. The actuator arm moves through an arcuate path and will force the door or gate into a closed position even when small amounts of material are disposed in the path of closing action since there is a substantial multiplication of the force exerted by the operator through the long actuator arm.

The compartment walls within the container housing are conveniently fabricated from sheet metal seated in channel elements to effect positioning. Desirably, a series of channel elements are provided at spaced points to allow repositioning of the partition walls to increase or decrease the volume of the various compartments as found to be necessary in a particular route or community.

As will be readily appreciated, it is desirable to reduce the weight of the container housing 14 in order to increase fuel economy and both volumetric and weight hauling capacity of recycled materials. Accordingly, the container housing and its frame are fabricated from lightweight metal alloys such as those of aluminum.

It will be appreciated that the latch 132 for the top compartment containing plastic materials in the illustrated embodiment may also be remotely actuated by an actuating lever extending through the sidewall 33 or by an electromechanical or hydraulic mechanism.

It has been found that the arrangement of the compartments in the illustrated embodiment is such that it permits facile cleaning of the storage compartments. Moreover, the small number of moving parts within the container housing minimizes the amount of maintenance required since the elements are of mechanical character with the exception of the compactor motor which is separately disposed within a relatively protected enclosure.

Thus, it can be seen from the foregoing detailed specification and attached drawings that the truck of the present invention enables a facile collection and temporary storage of recyclable materials which are discharged separately at a recycling center. The truck may be readily fabricated from components which will provide a long lived, relatively trouble-free structure. Moreover, the collection and discharge of materials may be effected by a single operator if so desired with a minimal requirement for handling of the materials segregated by the household owners.

Having this described the invention, what is claimed is:

1. A truck for separately storing and discharging recyclable materials comprising:

(a) a chassis;

(b) a cab on the front end of said chassis and having side walls and front and rear ends;

(c) a frame pivotably mounted on said chassis and extending rearwardly of said cab, said frame including a pair of parallel spaced side rails, and a plurality of spaced cross members extending transversely between said side rails and outwardly therebeyond;

(d) a housing on said frame and having front, rear, side, top and bottom walls;

(e) a platform supported on said frame and extending along one side wall of said housing to said cab;

(f) at least one door in the rear wall of said housing;

(g) vertically oriented, transversely extending partition walls in said housing dividing the interior space into a multiplicity of compartments along the length of said housing, one side wall of said housing having a multiplicity of openings each communicating with one of said compartments, said partition walls between said compartments having gates therein to provide a passage between compartments;

(h) locking mechanisms for holding said gates in a closed position and remote release mechanisms for unlocking said locking mechanisms and allowing said gates to open;

(i) an upper compartment above at least one of said first mentioned compartments, said upper compartment having a gate therein for discharge of the contents thereof;

(j) a chute extending upwardly between an opening in said one side wall of said housing and said upper compartment, said chute including a deflectable closure to permit insertion of recyclable materials thereinto and retention of such materials in said chute;

(k) a diagonally extending door on said rear end of said cab adjacent said platform to permit passage between said cab and said platform, said door being slidable between a closed position closing said cab and an open position extending along the adjacent side wall of said cab, whereby an operator may move from said cab onto said platform to place a multiplicity of types of recyclable materials in said several compartments for separate storage, and wherein said materials may thereafter be separately discharged by first opening said door in said rear wall of said housing to discharge the material in the rearmost compartment, then selectively opening said gates of the remainder of said compartments to discharge the material therein.

2. The truck in accordance with claim 1 wherein said door of said cab is slidably mounted on tracks.

3. The truck in accordance with claim 1 wherein said upper compartment has front, rear and side walls and is disposed on said top wall of said housing which provides its bottom wall.

4. The truck in accordance with claim 3 wherein said upper compartment extends to said rear wall of said housing and said gate of said upper compartment is provided by said rear wall of said upper compartment.

5. The truck in accordance with claim 1 wherein said deflectable closure is a resiliently deflectable closure mounted across the entry to said chute.

6. The truck in accordance with claim 5 wherein said closure has a multiplicity of vertically spaced horizontally extending slits, and a vertically extending slit located intermediate the width of said closure and generally bisecting said horizontally extending slits.

7. The truck in accordance with claim 6 wherein said closure is made of an elastomer.

8. The truck in accordance with claim 1 wherein the top surface of said side rails and said cross members generally lie in the same plane to form a flat bed for supporting said housing thereon.

9. The truck in accordance with claim 1 wherein said side rails are generally beams of generally box-shaped cross section, and said cross members are beams of generally C-shaped cross section.

10. The truck in accordance with claim 1 wherein said side rails include (a) a channel member having a vertically extending web and flanges extending horizontally outwardly at its upper and lower ends, (b) a second member having a base seated on the lower flange of said channel member, an upwardly and outwardly extending web and a flange at its upper end extending outwardly therefrom, and (c) a multiplicity of trapezoidal plate members extending between said webs of said channel member and said second member to increase the structural rigidity of said side rails.

11. The truck in accordance with claim 1 wherein said frame and said housing are made of aluminum.

12. The truck in accordance with claim 1 wherein said truck includes a vertically oriented, longitudinally extending partition wall between a pair of transversely extending partition walls to provide a pair of side by side compartments, and said locking mechanism includes cam elements to move said gates into a closed position, said cam element for said gate for one of said side by side compartments being supported on a first rotatable shaft, and said cam element for said gate of another of said side by side compartments being supported on a second rotatable tubular shaft concentric with said first shaft, whereby each of said shafts is separately rotatable to rotate said cam elements thereon and thereby release or engage its associated gate.

13. The truck in accordance with claim 1 wherein said remote release mechanism includes a mechanical linkage actuatable externally of said housing.

14. A truck for separately storing and discharging recyclable materials comprising:

(a) a chassis;

(b) a cab on the front end of said chassis and having side walls and front and rear ends;

(c) a frame pivotably mounted on said chassis rearwardly of said cab;

(d) a housing on said frame and having front, rear, side, top and bottom walls;

(e) a platform supported on said frame and extending along one side of said housing to said cab;

(f) at least one door in the rear wall of said housing;

(g) vertically oriented, transversely extending partition walls in said housing dividing the interior space into a multiplicity of compartments along the length of said housing, said partition walls between said compartments having gates therein to provide a passage between said compartments, one side wall of said housing having a multiplicity of openings each communicating with one of said compartments;

(h) a locking mechanism for holding said gates in a closed position and a remote release mechanism for unlocking said locking mechanism and allowing said gates to open;

(i) a diagonally extending door on said rear end of said cab adjacent said platform to permit passage between said cab and said platform, said door being slidable between a closed position closing said cab and an open position extending along the adjacent side wall of said cab, whereby an operator may move between said cab and said platform.

15. The truck in accordance with claim 14 wherein said door slides on tracks parallel to the side wall of said cab into its closed position.

16. A truck for separately storing and discharging recyclable materials comprising:

(a) a chassis;

(b) a cab on the front end of said chassis and having side walls and front and rear ends;

(c) a frame pivotably mounted on said chassis rearwardly of said cab;

(d) a housing on said frame and having front, rear, side, top and bottom walls;

(e) a platform supported on said frame and extending along one side wall of said housing to said cab;

(f) at least one door in the rear wall of said housing;

(g) vertically oriented, transversely extending partition walls in said housing dividing the interior space into a multiplicity of compartments along the length of said housing, said one side wall of said housing having a multiplicity of openings each communicating with one of said compartments, said partition walls between said compartments having gates therein to provide a passage between said compartments;

(h) locking mechanisms for holding said gates in a closed position and a remote release mechanism for unlocking said locking mechanisms and allowing said gates to open;

(i) an upper compartment above at least one of said first mentioned compartments, said upper compartment having front, rear and side walls and also having a gate therein for discharge of the contents thereof; and (j) a chute extending upwardly between an opening in said one side wall and said upper compartment, said chute including a deflectable closure at its entry to permit insertion of recyclable materials thereinto and retention of such materials in said chute.

17. The truck in accordance with claim 16 wherein said closure has a multiplicity of vertically spaced horizontally extending slits, and a vertically extending slit located intermediate the width of said closure and generally bisecting said horizontally extending slits.

18. The truck in accordance with claim 16 wherein said upper compartment has front, rear and side walls and is disposed on said top wall of said housing which provides its bottom wall.

19. The truck in accordance with claim 18 wherein said upper compartment extends from said rear wall of said housing, and said gate of said upper compartment is said upper rear wall of said upper compartment.

20. A truck for separately storing and discharging recyclable materials comprising:

(a) a chassis;

(b) a cab on the front end of said chassis and having side walls and front and rear ends;

(c) a frame pivotably mounted on said chassis rearwardly of said cab, said frame extending rearwardly of said cab and including a pair of parallel spaced side rails, and a plurality of spaced cross members seated in recesses in the upper portion of said side rails and extending transversely between said side rails and outwardly therebeyond, said side rails being beams of generally box-shaped cross section, and said cross members being beams of generally C-shaped cross section;

(d) a housing on said frame and having front, rear, side, top and bottom walls, the top surface of said side rails and said cross members generally lying in the same plane to form a flat bed for supporting said housing thereon;

(e) a platform supported on said frame and extending along one side wall of said housing to said cab;

(f) at least one door in the rear wall of said housing;

(g) vertically oriented, transversely extending partition walls in said housing dividing the interior space into a multiplicity of compartments along the length of said housing, said partition walls between said compartments having gates therein to provide a passage between said compartments, said one side wall of said housing having a multiplicity of openings each communicating with one of said compartments; and (h) locking mechanisms for holding said gates in a closed position and remote release mechanisms for unlocking said locking mechanisms and allowing said gates to open.

21. The truck in accordance with claim 20 wherein said side rails include (a) a channel member having a vertically extending web and flanges extending horizontally outwardly at its upper and lower ends, (b) a second member having a base seated on the lower flange of said channel member, an upwardly and outwardly extending web and a flange at its upper end extending outwardly therefrom, and (c) a multiplicity of trapezoidal plate members spaced along the length of said side rails and extending between said webs of said channel member and said second member to increase the structural rigidity of said side rails.

* * * * *